United States Patent [19]

Bean et al.

[11] Patent Number: 4,656,847

[45] Date of Patent: Apr. 14, 1987

[54] AUTOMATIC WASHER BALANCING RING WITH SPRING CLIP ATTACHMENT MEANS

[75] Inventors: David B. Bean, St. Joseph; Richard L. Fanson, St. Joseph Township, Berrien County, both of Mich.

[73] Assignee: Whirlpool Corporation, Benton Harbor, Mich.

[21] Appl. No.: 766,595

[22] Filed: Aug. 19, 1985

[51] Int. Cl.[4] ..... D06F 37/24

[52] U.S. Cl. ..... 68/23.2

[58] Field of Search ..... 68/23.2, 23.3; 494/82; 210/144, 363, 364; 73/573 R, 573 F; 403/361, 365

[56] References Cited

U.S. PATENT DOCUMENTS 1,909,353 5/1933 Hughes et al. ..... 403/361 X 2,529,219 11/1950 Kost ..... 403/361

FOREIGN PATENT DOCUMENTS 21064 2/1979 Japan ..... 68/23.2

*Primary Examiner*—Philip R. Coe

[57] ABSTRACT

An attachment arrangement is provided between a rotatable wash basket and a balancing ring in an automatic clothes washer which permits the ring to be locked onto the basket upon downward movement of the ring relative to the basket. The ring has a bottom wall with a channel therein which receives the edge of the basket opening. A plurality of spring clips having inwardly facing tangs are locked into the channel. The basket opening has a downwardly facing shoulder associated therewith and one of the tangs engages the edge of the opening below the shoulder to prevent removal of the ring while the other, opposed tang provides a biasing force to prevent the tang from disengaging from the shoulder.

9 Claims, 9 Drawing Figures

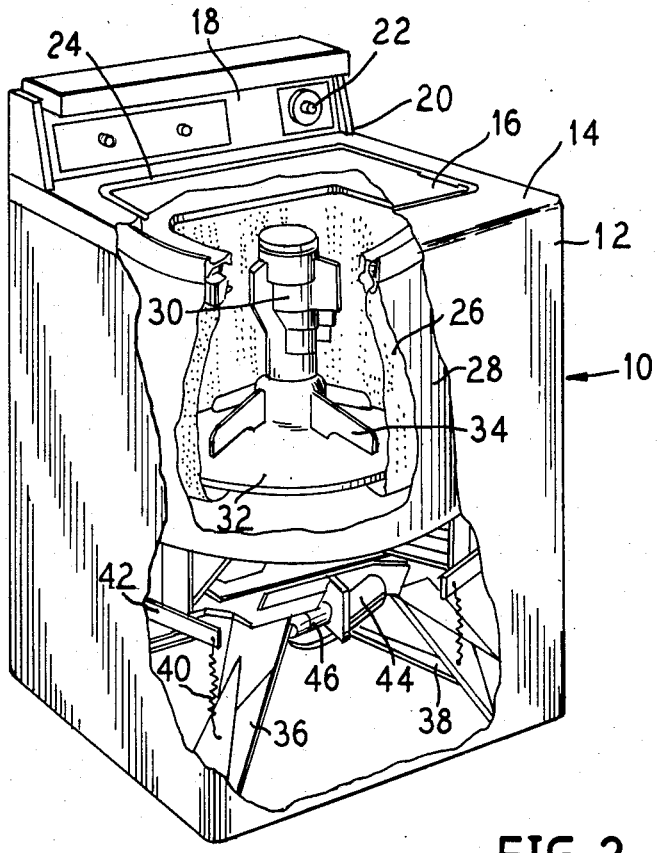
FIG. 1
FIG. 2
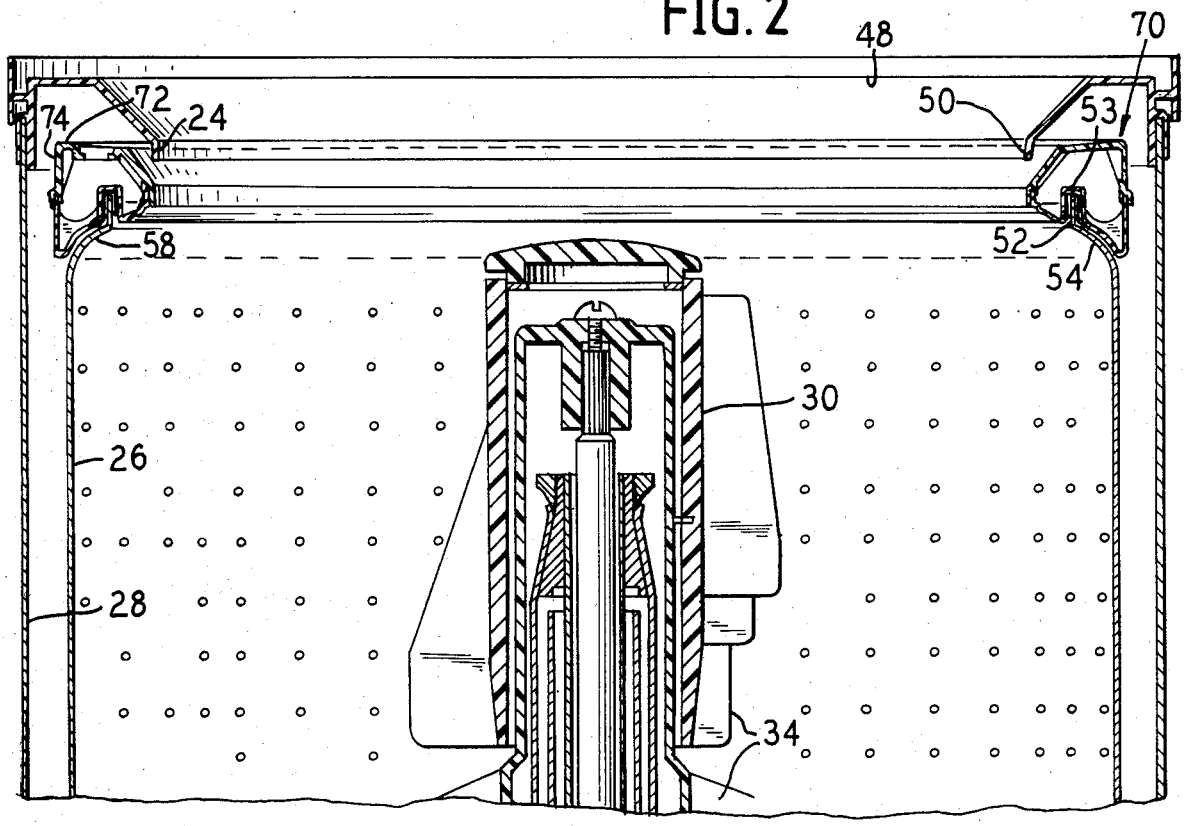

FIG. 5
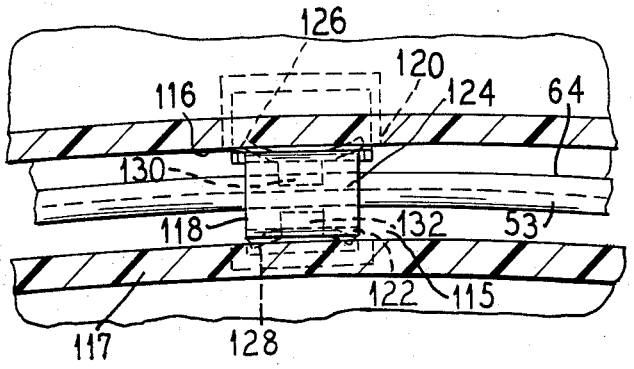
FIG. 7
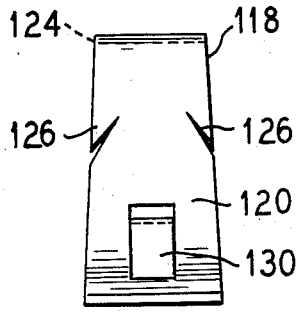
FIG. 8
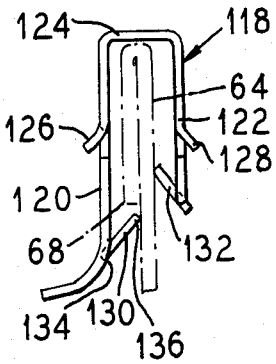
FIG. 9
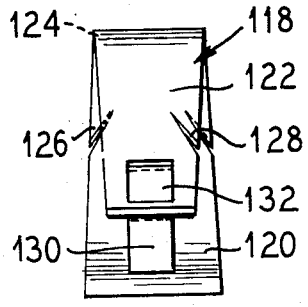
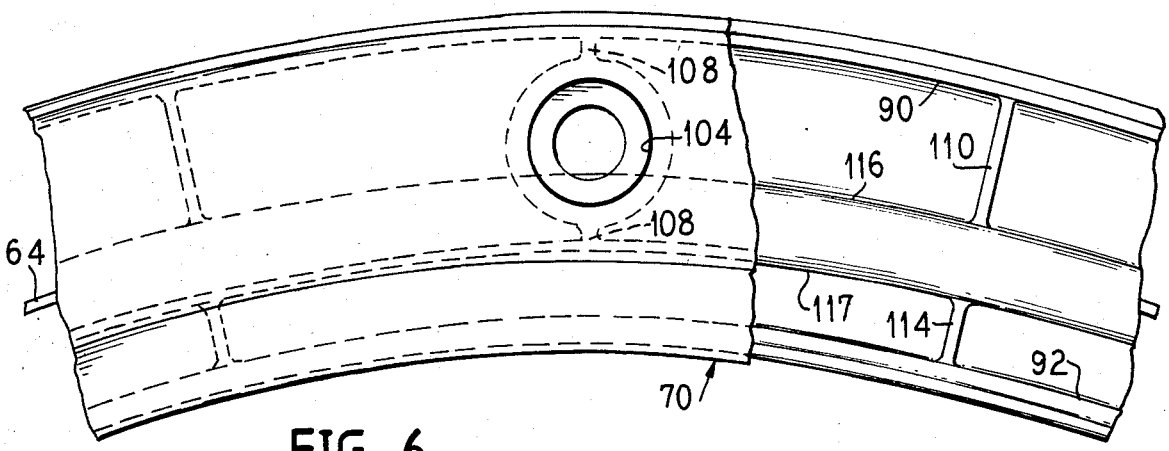
FIG. 6

AUTOMATIC WASHER BALANCING RING WITH SPRING CLIP ATTACHMENT MEANS

BACKGROUND OF THE INVENTION

1. Field of the Invention

The present invention relates to washing machines and more particularly an improved means for attaching a balancing ring to an automatic washer basket.

2. Description of the Prior Art

It is common practice in an automatic washer to provide a balancing ring around the top periphery of the wash basket to stabilize the basket as it rotates during the high spin mode.

The wash basket is spun with the clothes load during spin operations, and it is important that the balancing ring be securely attached to the basket so that it does not work loose during such operations. Further, the balancing ring must be capable of being securely attached to the basket regardless of manufacturing tolerances which effect the concentricity of the basket.

U.S. Pat. No. 4,433,592 discloses a balance ring which contains both a low viscosity fluid and a plurality of spherical weights to effect balancing during spin. The balancing ring and the spin basket have cooperating flanges and are secured together by means of screws through the flanges.

U.S. Pat. No. 4,388,841, discloses a universal balancing member which comprises a hollow, annular tube member which is secured to the spin basket by means of a plurality of clip members. The clip members each extend around the outer surface of the balancing tube and have an outwardly extending head portion which snaps through a cooperating hole in the upper basket periphery.

U.S. Pat. No. 4,162,621 discloses, incidentally, a balancing ring which is fixed to the upper portion of the basket and contains a granular balancing material. Although details of the construction and attachment means for the balancing ring are not disclosed, it appears that the ring is formed of a metal member which is secured to a metal spin basket, as by welding.

U.S. Pat. No. 4,044,626 discloses a hollow, two-piece balancing ring assembly for an automatic washer. The ring includes a plurality of internal baffles extending upwardly from its bottom wall and downwardly from its top wall to modify the flow of balancing liquid within the ring. The ring is attached to the upper periphery of the spin basket by means of screws.

U.S. Pat. No. 3,610,069 discloses a one-piece balancing ring which is designed to receive a solid balancing material, such as concrete. The ring is secured to the basket by means of a plurality of screws so that the ring extends interior of the basket opening.

U.S. Pat. No. 3,462,198 discloses a balancing ring which may be used in connection with an automatic washer or other rotating mechanisms. The balancing ring is secured to the outer surface of the spin basket by means of inwardly extending projections which snap-fit to the holes in the basket. At least a portion of the balance ring can be displaced radially in response to the spinning of the basket.

U.S. Pat. No. 3,334,497 discloses an automatic washer having a balance ring which is spot welded to the inner wall of the basket. The ring contains a solid ballast material, such as cement.

U.S. Pat. No. 2,836,083 discloses a balancing ring containing a thixotropic material which is secured to the outer periphery of the basket by means of brackets which are bolted to the basket.

In each of the prior art disclosures described above, the balance ring is secured to the basket either by welding, a plurality of fasteners such as screws, or other time consuming methods in which a fastener has to be lined up with a hole in the basket, some of which may be insufficient to withstand the constant vibration and the starting and stopping of the spin basket as it moves into and out of the high spin mode.

SUMMARY OF THE INVENTION

The present invention provides a novel attachment means for a balancing ring for an automatic washer. In particular, it is an object of the invention to provide attachment means which allows the ring to be affixed to the upper basket periphery without the need for screws or other fastening means which require separate manipulation at the time of installation. It is also an object of the invention to provide fastening means which permit the ring to be installed using automated assembly equipment or, alternatively, a minimum of manual labor. It is a further object of the invention to provide an attachment means which does not require rotational alignment of the ring with the wash basket.

An annular balancing ring is provided which rests on a shoulder of the wash basket and has an inverted channel in a bottom wall to receive the rim surrounding a top opening of the wash basket. The balancing ring is provided with a plurality of clips installed in the channel prior to assembly onto the basket which engage with a downwardly facing formed edge or shoulder portion of the basket forming the top opening.

The clips have outwardly projecting barbs which engage with side walls of the channel to hold the clips in the channel and right and left tangs to engage the lip forming the basket opening. The tangs press inwardly projecting against the basket lip and the tang on the radial outside of the lip has an end which catches below the formed edge on the lip to prevent the ring from disengaging from the lip.

The ring is assembled onto the basket by placing it over the basket opening with the channel aligned with the lip and pressing down. The clips are made of a resilient material and thus will automatically engage the lip and the formed edge.

The fact that the basket is coated with a hard porcelain glaze presents the primary problem that must be dealt with in developing attachment means. In particular, the porcelain presents an extremely hard surface that resists frictional gripping or engagement by a simple barb or tang. Further, it is highly undesirable that the porcelain surface be fractured, cracked, or scratched by the attachment means, since this would permit the basket to rust at that point. Thus, the shoulder defined by the folded back edge portion of the basket lip plays an important part in the invention, since it permits the lower tang on the spring clip to prevent upward movement of the ring even though the clip does not dig into or otherwise grip the hard porcelain surface itself. The tang on the opposite side of the clip does not dig into the porcelain surface, but rather provides a spring bias to retain the first tang below the shoulder.

Since the attachment means disclosed does not require holes through the basket for receiving screws, clips or other fasteners, there is no concern about tolerances of the holes, occluding the holes, or chipping the porcelain at the holes.

Internal baffles are provided within the balance ring to slightly impede the fluid within the ring but allowing some movement of the fluid. The fluid must be able to move quick enough to counter-balance the off-balance weight when the basket is accelerating to the top spin speed. When there is no off-balance weight, the balancing fluid must be prevented from moving around the balancing ring to create an off-balance. If the fluid is restrained too much, the fluid within the ring will not move fast enough in acceleration of the basket to the top spin speed. This would cause the basket to hit the cabinet and create an unstable system. It has been found that 55–65% of the balancing ring volume filled with water is the best condition. Small baffles protruding into the center of the ring retard the flow of water.

BRIEF DESCRIPTION OF THE DRAWINGS

FIG. 1 is a perspective view of an automatic washer embodying the principles of the present invention.

FIG. 2 is a partial side sectional view through the interior of the washer showing the balancing ring.

FIG. 5 is a partial sectional view of the balancing ring taken generally along the line V—V of FIG. 4.

FIG. 6 is a partial plan view of the balancing ring assembled onto the wash basket taken generally along the line VI—VI of FIG. 4.

FIG. 7 is a side elevational view of a fastening clip.

FIG. 8 is a side elevational view of the fastening clip of FIG. 7 rotated 90°.

FIG. 9 is a side elevational view of the fastening clip of FIG. 7 rotated 180°.

DESCRIPTION OF THE PREFERRED EMBODIMENTS

Figure 3:
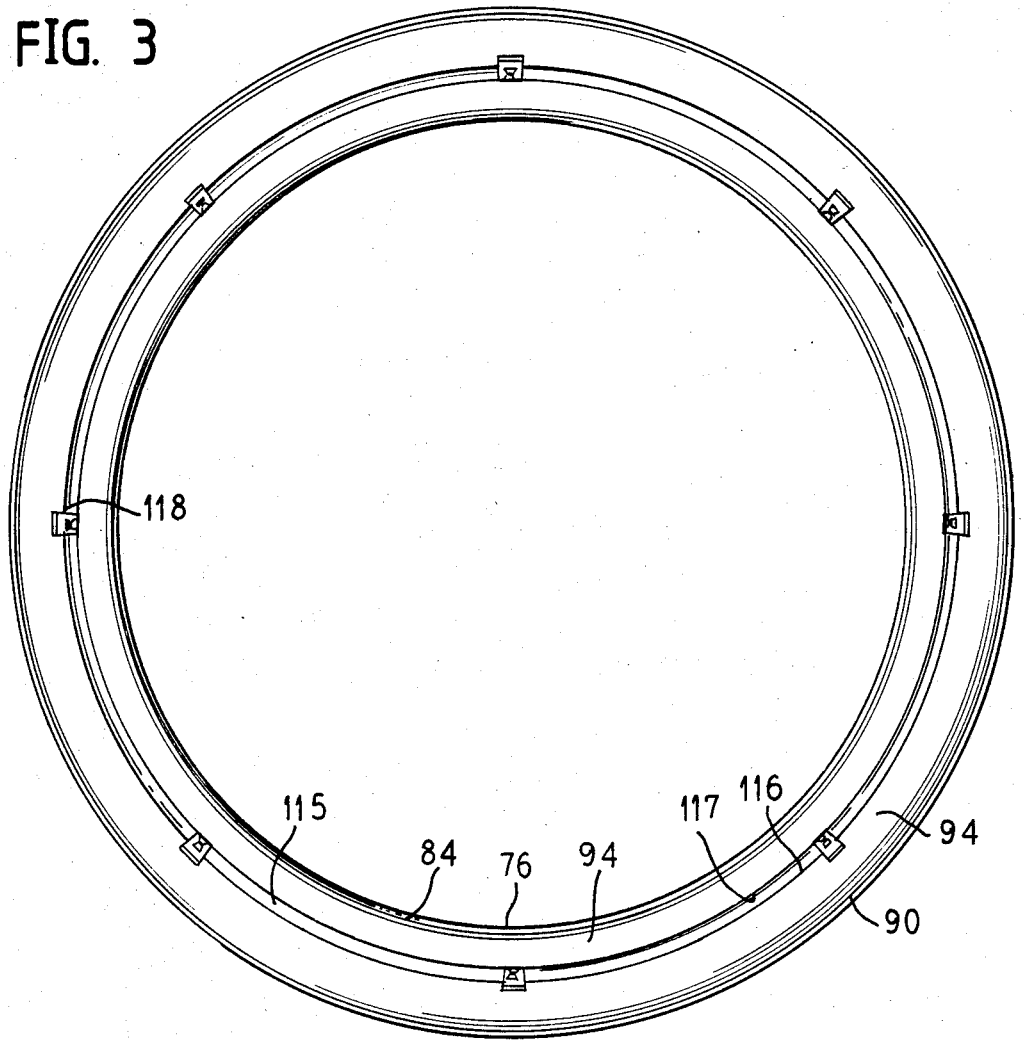
FIG. 3 is a bottom elevational view of the balancing ring.

In FIG. 1, there is illustrated an automatic washing machine generally at 10 having an exterior cabinet 12 with a top surface 14 and an openable lid 16 forming a portion of the top surface. A control console 18 is positioned at a rear edge 20 of the top panel 14 and has on it a plurality of controls 22 for presetting the operation of the washer to operate through a series of washing, rinsing and drying steps.

Accessible through an opening 24 covered by the lid 16 is a perforate wash basket 26 concentrically mounted within an imperforate wash tub 28. Mounted centrally within the wash basket 26 is a vertical axis agitator 30 having a lower skirt portion 32 and a plurality of radially outwardly extending vanes 34.

The wash tub assembly is carried on supporting legs 36 which are connected to a washer frame 38 interior of the cabinet 12. Springs 40 are attached between the legs 36 and a plurality of brackets 42 secured to the tub assembly. The agitator 30 is selectively rotated and wash basket 26 is selectively rotated by means of an electric motor 44 through an appropriate transmission 46.

The interior of the wash basket 26 is shown in greater detail in FIG. 2 which is a cross-sectional view of the upper portion of the wash basket 26. It is clearly seen that the wash basket 26 is mounted concentrically within the wash tub 28 and that the agitator 30 is centrally located. The wash tub 28 has an attached top ring 48 with an opening 50 therein providing access to the interior of the wash basket 26. The wash basket 26 has a substantially circular opening 52 at a top edge 53 thereof which is smaller in diameter than the internal diameter of the wash basket 26 itself in that a curled upper lip 54 is formed at the top end of the basket 26 to form the opening 52.

Figure 4:
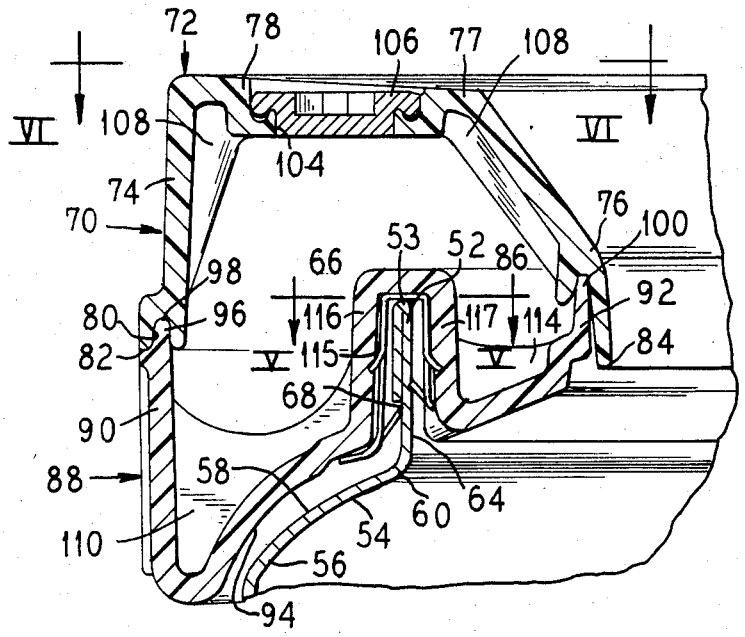
FIG. 4 is an enlarged partial side sectional view of the balancing ring.

The curled lip portion 54 is shown in greater detail in FIG. 4 where it is seen that there is a first inwardly curved portion 56 which extends inwardly from the diameter of the wash basket 26 thereby forming an exterior shoulder 58 near a top portion of the wash basket. The slope of the curved portion 56 decreases in a direction toward the top edge 53 of the basket 26 to a transition point 60 from which point the slope increases to a vertical slope at a neck portion 64 forming the opening 52. A portion 66 of the lip wall 54 is folded back on itself, radially outwardly, the fold forming the top edge 53 of the basket and an end of the wall forming a downwardly facing formed edge or shoulder 68.

In FIGS. 2 and 4, it is seen that there is provided a balancing ring 70 which is seated on the top edge portion 53 of the wash basket surrounding the top opening 52 of the basket. The balancing ring 70 has an upper member 72 with an outer annular wall 74 and an inner annular wall 76 connected along a top edge 77 by a top wall 78. A bottom edge 80 of the outer annular wall 74 is enlarged and has an annular groove 82 formed therein and a bottom edge 84 of the inner annular wall 76 has an annular groove 86 formed therein.

The ring member 70 also has a bottom portion 88 with an outer annular wall 90 and a relatively short interior annular wall 92 connected by a curved bottom wall 94. The outer annular wall 90 has a ridge portion 96 projecting upwardly from a top edge 98 of the outer wall 90 which mates with the annular groove 82 in the outer wall 74 of the top member 72. The inner wall 92 of the bottom member 88 has an annular edge 100 projecting to mate with the annular groove 86 of the upper member inner wall 76. The top and bottom members 72, 88 are preferably formed of a molded thermoplastic material such as polypropylene and can be permanently joined together such as by spin welding the two portions so that the ridges or edges 100, 96 will be joined to the grooves 86, 82 respectively in a water-tight manner. Other fastening methods can be used including adhesives or sonic welding techniques.

The top wall 78 of the top portion 72 is formed with at least one opening 104 therethrough sealable by a plug 106 to provide access to the otherwise sealed interior of the balancing ring.

Formed in the bottom wall 94 of the bottom portion 88 of the balancing ring 70 is a downwardly opening annular channel 115 formed by two annular walls 116, 117. One wall 116 has a diameter greater than the neck portion 64 and the other wall 117 has a diameter smaller than the neck portion 64 such that the neck 64 will be received in the channel 115. A plurality of clips 118 are captured at spaced locations around the circumference of the channel 115 as best seen in FIG. 3. The clips 118 are shown in detail in FIGS. 7, 8 and 9 where it is seen that the clips comprise generally a U-shaped member having a first downwardly extending leg 120 and a spaced, second downwardly extending leg 122 connected at a bight by a connecting portion 124. A pair of barbs 126 are formed in the first leg and a second pair of barbs 128 are formed in the second leg, both sets of barbs being turned outwardly on the clip and having a sharp, pointed edge. The first leg has an inwardly projecting tang 130 and the second leg has an inwardly projecting tang 132, the tang 130 on the first leg being positioned farther from the connecting end 124 than the tang 132 on the second leg.

Molded on the interior of the upper member 72 are a plurality of reinforcing members 108 which extend partially into the interior of the ring member primarily in the areas adjacent the joinder of the top wall 78 to the outer wall 74 and inner wall 76.

Molded within the interior of the bottom portion 88 are a plurality of baffle members 110 which extend from the outer channel wall 116, along the bottom wall 94 to the outer wall 90. Additional baffles 114 are also molded on the interior of the bottom portion 88 which extend from the inner wall 92 to the inner channel wall 117. The profile of all of the baffles combined is such that the majority of the area interior of the ring is left unimpeded.

As seen in FIGS. 4 and 5, when the clip 118 is inserted into the channel 115 in the balancing ring, the barbs 126, 128 engage into the side walls of the channel to securely lock the clip 118 to the ring 70. When the ring 70 is placed onto the basket, the neck portion 64 of the basket lip is received in the channel 115 and the tangs 130, 132 engage opposite walls of the neck portion. The tang 130 on the first leg 120 engages the radially outward side of the neck wall and the tang 132 on the second leg 122 engages the radially inward side of the neck wall.

The entire wash basket is coated with a very hard and smooth porcelain glaze which prevents any gripping or frictional engagement between a fastening means and the porcelain coated wall. Further, it is highly desirable not to scratch or crack the porcelain glaze in order to avoid rusting of the underlying metal. Therefore, the tang 132 on the second leg 122 merely presses against the radially interior surface of the neck portion 64 and the tang 130 of the first wall also merely presses against the radially exterior surface of the neck portion, but the tang 130 is also positioned below the shoulder 68 formed by the folded over end of the lip such that once the tang 130 has passed below the shoulder 68 it can no longer be pulled upwardly past the shoulder. This is due to the configuration and attachment of the tang 130 wherein a bottom edge 134 is attached to the leg 120 from which it was originally formed and a top edge 136 is free and which engages the shoulder 68. Because of the continuous biasing of the tang 132 of the second leg, the free end 136 of tang 130 is effectively prevented from disengaging with the shoulder 68.

Thus, once the balancing ring 70 is pressed onto the neck portion 64 of the wash basket lip 54, it is prevented from further movement in a vertical direction. Although the ring is not restrained from rotational movement relative to the wash basket, it has been determined during experimental use of a ring embodying the principles of the present invention that any rotational movement between the two parts is minimal and if it occurs, it is only during the rapid braking of the basket after a high speed spin operation. Rotational acceleration of the basket during the beginning of a high speed spin operation is much slower than the deceleration during braking and during the slower acceleration, there is virtually no movement of the ring relative to the basket. During the spin operation itself, the basket is rotating at a constant velocity and thus there is no acceleration and thus no movement of the ring relative to the basket.

FIG. 6 shows the spacings of the baffles formed internally of the balancing ring 70. Near the right hand portion of the figure, the baffles 110, 114 formed in the bottom member 90 are illustrated. The reinforcing ribs 108 formed on the top member 72 are shown in phantom as being closely adjacent to either side of the opening 104. These rib members may act to slightly impede the fluid within the ring, but their primary function is to add structural strength to the ring.

The ring 70 can be filled with a fluid through the opening 104 to provide the balancing function for the ring. The fluid must be able to move quickly enough within the ring to counter-balance an off-balance weight when the basket is accelerating to the top spin speed. For example, if a disproportionate amount of clothing is positioned on one side of the basket, this would result in an off-balance condition. The fluid within the ring will move to an area on the opposite side of the basket, thus counteracting off-balance condition. However, the balancing fluid must be prevented from moving around the balancing ring to create an off-balance condition when there is no off-balance weight. Thus, the internal baffles are used to prevent the unobstructed movement of the liquid within the ring. It has been determined by the Applicants that 55–65% of the balancing ring volume filled with a fluid such as water provides the best operating condition.

It is thus seen that there is provided by the present invention a means for attaching the balancing ring 70 to the wash basket 26 comprising a plurality of spring clips which snap-fit and lock to both the balancing ring and the basket. By providing the basket lip with a folded back portion or equivalent portion defining a downwardly facing shoulder, a fastening means is provided which allows for a quick and efficient means to securely attach the balancing ring to the wash basket in the form of a spring clip which is retained by the ring and which snap-fits beneath the shoulder. The balancing ring can be applied very quickly by manual effort or can be quickly and effectively attached using automated machinery. Since the balancing ring is virtually permanently attached, with no parts such as threaded fasteners to loosen, periodic checks of the balancing ring are not required.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contributions to the art.

The embodiments of the invention in which an exclusive property or privilege is claimed are defined as follows:

1. The combination of a wash basket and balancing ring comprising:

a wash basket having a circular opening at a top end thereof;

an annular upwardly projecting lip on said basket adjacent said opening;

an annular downwardly facing shoulder provided on said basket lip;

a balancing ring member sized to rest on said annular lip;

said ring member having a channel formed in a bottom wall thereof for receiving said annular lip;

a plurality of clips retained in said channel; said clips having inwardly extending tangs for engaging radially interior and exterior surfaces of said lip, one of said tangs engaging said lip below said shoulder;

whereby, the engagement of said one tang with said shoulder secures said balancing ring against removal from said basket lip.

2. The combination according to claim 1 wherein said shoulder is formed on said radially exterior surface of said lip.

3. The combination according to claim 1 wherein said shoulder is defined by a downwardly facing end of a folded over portion of said lip.

4. The combination according to claim 1 wherein said clips have outwardly extending barbs engageable with said ring channel to lock said clips to said ring.

5. The combination according to claim 1 wherein said one tang engaging said shoulder is positioned lower than said other tang.

6. The combination according to claim 1 wherein said balancing ring is hollow for receiving a liquid therein.

7. The combination according to claim 1 wherein said balancing ring includes a plurality of interior baffles for impeding the movement of said liquid within said ring.

8. The combination of a wash basket and balancing ring comprising:

a wash basket having an opening defined by a substantially circular vertical wall at a top end thereof;

a downwardly facing annular shoulder formed on said basket adjacent to said top end;

a balancing ring sized to surround said opening and having a bottom wall engageable with said vertical wall; said bottom wall having an annular channel therein for receiving said vertical wall;

a plurality of spring clips capturable in said annular channel;

said spring clips having outwardly extending barbs for locking said clips to said channel and having opposed inwardly extending tangs for engaging radially interior and exterior surfaces of said vertical wall;

one of said tangs being engageable with said vertical wall below said shoulder;

whereby said ring is placeable about said opening in said basket and is locked to said basket by said one tang engaging said shoulder after said ring is pushed downwardly on said vertical wall.

9. For use in an automatic washer, the combination of a rotatable wash basket and balancing ring comprising:

a wash basket having an opening at a top end thereof;

a balancing ring member sized to be attachable to said wash basket at an upper periphery thereof;

cooperating means on said wash basket and ring member to lock said ring member onto said basket upon downward movement of said ring about said basket upper periphery;

said cooperating means comprising an annular upstanding wall formed on said basket and a downwardly facing channel formed in said ring, said wall being receivable in said channel, and locking means in said channel to lock said ring onto said basket;

said locking means comprising a plurality of clips spaced around said channel to lockingly engage said upstanding wall; and said upstanding wall having a downwardly facing shoulder provided thereon which is engageable by said clips for locking said ring to said basket.

* * * * *